US008747969B2

(12) United States Patent
Lu

(10) Patent No.: US 8,747,969 B2
(45) Date of Patent: Jun. 10, 2014

(54) COATED FILMS FOR INKJET PRINTING

(75) Inventor: Pang-Chia Lu, Pittsford, NY (US)

(73) Assignee: Jindal Films Americas LLC, Macedon, NY (US)

( * ) Notice: Subject to any disclaimer, the term of this patent is extended or adjusted under 35 U.S.C. 154(b) by 170 days.

(21) Appl. No.: 13/142,151

(22) PCT Filed: Feb. 11, 2009

(86) PCT No.: PCT/US2009/033798

§ 371 (c)(1),
(2), (4) Date: Jun. 24, 2011

(87) PCT Pub. No.: WO2010/093358

PCT Pub. Date: Aug. 19, 2010

(65) Prior Publication Data

US 2011/0254909 A1 Oct. 20, 2011

(51) Int. Cl.
*B41J 2/01* (2006.01)
*B41M 5/40* (2006.01)

(52) U.S. Cl.
USPC ..... 428/32.38; 347/102

(58) Field of Classification Search
None
See application file for complete search history.

(56) References Cited

U.S. PATENT DOCUMENTS

| | | | | |
|---|---|---|---|---|
| 6,596,379 | B2 | 7/2003 | McGee | |
| 6,800,340 | B1 | 10/2004 | Francescutti | |
| 6,844,034 | B2 | 1/2005 | Touhsaent | |
| 6,857,737 | B2 | 2/2005 | Emslander et al. | |
| 6,893,722 | B2 * | 5/2005 | McGee | 428/422.8 |
| 7,182,455 | B2 | 2/2007 | Sebastian et al. | |
| 7,238,399 | B2 | 7/2007 | Ohya et al. | |
| 7,335,407 | B2 | 2/2008 | Landry-Coltrain et al. | |
| 7,387,381 | B2 | 6/2008 | Katoh et al. | |
| 2006/0292318 | A1 | 12/2006 | Parrinello et al. | |
| 2007/0035604 | A1 * | 2/2007 | Jang | 347/102 |

* cited by examiner

*Primary Examiner* — Sheeba Ahmed

(57) ABSTRACT

Provided are coated films suitable for inkjet printing applications using UV-curable inkjet ink. The films are coated with cationically stabilizable emulsion polymers. The emulsion polymers contain cationically stabilizable amino-functional polymers. Also provided is a method of printing with a UV-inkjet printer comprising jetting UV-curable inkjet ink onto the coated film substrate to form an ink printed image.

14 Claims, No Drawings

COATED FILMS FOR INKJET PRINTING

CROSS-REFERENCE TO RELATED APPLICATIONS

This application is a National Stage Application of International Application No. PCT/US2009/033798, filed Feb. 11, 2009, the contents of which are incorporated by reference in its entirety.

FIELD OF THE INVENTION

This disclosure relates to coated films suitable for inkjet printing. More particularly, this invention relates to films coated with cationically stabilizable amino-functional polymer coatings making the film suitable for ink jet printing applications using UV-cured inkjet ink.

BACKGROUND OF THE INVENTION

The development of commercially acceptable coated plastic films for printing applications is often a compromise between a variety of desired properties. For example, printed labels, such as those used for beverage containers or health and beauty containers, should be capable of exposure to any severe conditions encountered during manufacturing, transport, and storage. Not only should printable coatings exhibit hot-water resistance, organic-solvent resistance, abrasion resistance, and haze resistance on exposure to hot or cold water, the coating should also exhibit good ink adhesion immediately after printing. For example, the ink on an imaged beverage container label should stay adhered to the coated film after the label is made and applied to the container, even when exposed to hot or cold water or any other subsequent abrasion that may be encountered in mechanized handling.

The combination of the ink, substrate, and printing method used greatly affects the image quality of the final printed article. For example, in contact printing methods such as screen-printing, a blade forces the ink to advance and wet the receiving substrate, while in the case of non-contact printing methods, such as inkjet printing, the individual ink drops are merely deposited on the surface. Accordingly, ink/substrate combinations that result in good image quality when printed with contact methods such as screen printing, often exhibit insufficient wetting when printed with non-contact printing methods such as inkjet printing resulting in low radial diffusion of the individual ink drops on the surface of the substrate (e.g., "dot gain"), low color density, and banding effects (e.g., gaps between rows of drops).

Inks used in the various printing methods often have different physical properties. For example, inks used in screen printing and lithography printing techniques typically do not meet the low viscosity requirements of inks used in inkjet printers. Screen printing ink compositions typically have a viscosity of at least two orders of magnitude greater than the viscosity of inkjet printing inks, and it is not generally feasible to dilute a screen printing ink to make it suitable for inkjet printing as the addition of large amounts of low viscosity diluents drastically deteriorates the ink performance and properties, particularly the durability. Additionally, inkjet inks may vary depending on the type of inkjet printing used. For example, some inkjet printers use water or solvent based inks, while UV-inkjet printers generally use solvent free (i.e., 100% solids) inks.

It would be highly desirable to have a plastic film that is suitable for use in inkjet printing applications, particularly those using UV-curable inkjet ink. It would be desirable to have a coated film that has good ink adhesion immediately after printing, especially at high printing speeds and allows for the formation of high quality print images.

U.S. Pat. No. 6,596,379 discloses coating compositions and plastic films thus coated. The coating composition comprises a cationically stabilized emulsion polymer comprising a combination of at least one polymerizable monomer which is uncharged or positively charged in an aqueous solution having a pH between 1 and 8, polymerized in the presence of at least one water-soluble polymer having a number-average molecular weight greater than 5000 which comprises a moiety selected from the group consisting of primary amines, secondary amines, tertiary amines, and quaternary ammonium salts.

U.S. Pat. No. 6,893,722 discloses a cationically stabilizable amino-functional polymer having a number-average molecular weight greater than 3000 which exists in the presence of water as a solution or stable emulsion only when the pH is less than or equal to 8. Upon drying the polymer contains ethenically unsaturated moieties selected from the group consisting of acrylic, methacrylic, and enamine. The polymer is useful for promoting adhesion of curable inks and other coatings for plastic films.

SUMMARY OF THE INVENTION

In one aspect, this disclosure relates to an article comprising (a) a film substrate; (b) a coating composition applied to the film substrate; and (c) an ink print image printed on the coating composition by a UV-inkjet printer using UV-curable inkjet ink.

In another aspect, this disclosure relates to a method of printing with a UV-inkjet printer comprising jetting UV-curable inkjet ink onto a coated film substrate to form an ink printed image, wherein the coated film substrate comprises a film substrate and a coating composition applied to the film substrate.

In one embodiment, and in combination with any of the above disclosed aspects the coating composition comprises:

i. a cationically stabilized emulsion polymer that comprises on a dry basis:

1. 30 to 97 wt % of at least one vinylic non-acidic monomer which is uncharged or positively charged in an aqueous solution having a pH between 1 and 8; and
2. 3 to 70 wt % of at least one water-soluble polymeric compound having a number-average molecular weight greater than 5000 which comprises a moiety selected from the group consisting of primary amines, secondary amines, tertiary amines, and quaternary ammonium salts;

ii. a cationically stabilized emulsion polymer that comprises on a dry basis:

1. 70 to 99 wt % of an amino-functional polymer; and
2. 1 to 30 wt % of an unsaturation number enhancer element selected from the group consisting of

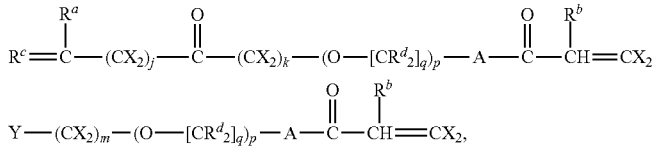

and where Y is selected from the group consisting of halogen and three-membered oxirane ring, $R^a$ and $R^b$ are the same or different and selected from the group consisting of H and $C_1$ to $C_6$ alkyl, $R^c$ is selected from the group consisting of O and $CX_2$, each X can be the same or different and is selected from the group consisting of H, hydroxyl, and halogen, $R^d$ is selected from the group consisting of H, hydroxyl, halogen, and any organic radical containing at least one carbon atom, wherein each $R^d$ can be the same or different, A is selected from the group consisting of O and $NR^d$, $CR^d$ and $CR^d{}_2$ can each be a separate moiety or a portion of a cyclic structure, j, k, and m are integers ranging from 0 to 6, inclusive, q is an integer ranging from 1 to 6, inclusive, and p is an integer ranging from 0 to 30, inclusive; or iii. a mixture of (i) and (ii).

In some embodiments, and in combination with any of the above disclosed aspects or embodiment, the coating composition is selected from (i) and (iii) as described above and the vinylic non-acidic monomer(s) is an epoxy-functional monomer selected from the group consisting of glycidyl acrylate and glycidyl methacrylate.

In some embodiments, and in combination with any of the above disclosed aspects or embodiment, the coating composition is selected from (i) and (iii) as described above and the water-soluble polymeric compound comprises nitrogen-containing monomer selected from the group consisting of acrylonitrile and methacrylonitrile.

In some embodiments, and in combination with any of the above disclosed aspects or embodiments, the coating composition is selected from (ii) and (iii) as described above and the amino-functional polymer is a condensation product of a reaction between an amino-functional polymer comprising reactive amine hydrogens with an element selected from the group consisting of halo-functional monomer, halo-functional oligomer, carbonyl-functional monomer, carbonyl-functional oligomer, epoxy-functional monomer, epoxy-functional oligomer, poly-functional acrylic monomer, poly-functional acrylic oligomer, poly-functional methacrylic monomer, and poly-functional methacrylic oligomer, said element containing or forming upon drying an ethenically unsaturated moiety selected from the group consisting of acrylic, methacrylic, and enamine.

In another embodiment, and in combination with any of the above disclosed aspects or embodiments, the coating composition reacts with the UV-curable inkjet ink.

In yet another embodiment, and in combination with any of the above disclosed aspects or embodiments, the film substrate comprises a polyolefin selected from polypropylene, polyethylene, ethylene-propylene copolymers, propylene-butene copolymers, ethylene-propylene-butylene terpolymers, and blends thereof.

In other embodiments, and in combination with any of the above disclosed aspects or embodiments, the film substrate is oriented in at least one direction and is preferably biaxially oriented.

These and other features, aspects, and advantages of the present disclosure will become better understood with regard to the following description and appended claims.

DETAILED DESCRIPTION OF THE INVENTION

Various specific embodiments, versions and examples of the invention will now be described, including preferred embodiments and definitions that are adopted herein for purposes of understanding the claimed invention. While the following detailed description gives specific preferred embodiments, those skilled in the art will appreciate that these embodiments are exemplary only, and that the invention can be practiced in other ways. For purposes of determining infringement, the scope of the invention will refer to any one or more of the appended claims, including their equivalents, and elements or limitations that are equivalent to those that are recited. Any reference to the "invention" may refer to one or more, but not necessarily all, of the inventions defined by the claims.

As used herein, the term "cationically stabilizable amino-functional polymer" relates to an amino-functional polymer that is capable of existing in the presence of water as a solution or a stable emulsion when the pH is less than or equal to 8. This term is inclusive of cationically stabilizable amino-functional polymer, i.e., said polymer in its stabilized form. Loss of stability of the emulsifiable polymer can manifest itself in several ways: loss of performance (e.g., due to hydrolysis of a functional monomer) as well as coagulation or separation such that it cannot be redispersed under low-shear conditions (i.e., a shear rate of less than 38000 $s^{-1}$). In the present invention, a "stable emulsion" (absent fillers and other additives) is one that is dispersible under low-shear conditions or that has a functional shelf-life of at least two weeks without observable separation or coagulation, or, if, observable separation or coagulation does occur, redispersion can be effected at low-shear conditions as described above. In other words, an unstable emulsion is one that cannot be redispersed or that can only be dispersed under high-shear conditions with a high-shear mixer at a shear rate of at least 38000 $s^{-1}$ or in a sonicator at a power density of at least 4 watts per milliliter $sec^{-1}$.

The cationically stabilizable, amino-functional polymer has positive charges along its backbone, which are generally associated with negatively charged counterions like $Cl^-$, $Br^-$, $NO_3^-$, $SO_4^{-2}$, $RCO_2^-$, derived from inorganic or organic acids of relatively low molecular weight. However, where such positively charged polymers are mixed with another polymer having anions on the polymer backbone, the two polymers will coagulate. Moreover, if the localized pH around the cationic polymer exceeds 8.0, "kick out" or coagulation of the polymer will occur. Accordingly, it is important that these materials be prepared in an environment that minimizes exposure to the anionic polymer.

Self curing embodiments of the amino-functional polymer include those wherein at least one of the monomer(s) is an epoxy-functional monomer and the water-soluble polymeric compound has a number average molecular weight greater than 3000, or in some embodiments greater than 5000, and comprises a moiety selected from the group consisting of primary amines, secondary amines, tertiary amines, and quaternary ammonium salts. The epoxy-functional monomer can be selected from the group consisting of glycidyl acrylate and glycidyl methacrylate ("GMA"). In a preferred embodiment, the self-curing, cationically stabilizable emulsion polymer comprises at least one of said monomers that is a nitrogen-containing monomer that may be, for example, selected from the group consisting of acrylonitrile and methacrylonitrile. Preferably, the water-soluble polymeric compound is present in an amount sufficient to stabilize an emulsion of the polymer and react with the epoxy-functional monomer when the emulsion is dried. The ratio of epoxy equivalents to reactive amine hydrogen equivalents in self-curing polymer can vary widely. However, a preferred ratio is in the range between 1:1 and 3:1, with a ratio between 1.5:1 and 2.5:1 being more preferred.

As used herein, "amino-functional polymer" relates to a polymer which comprises a sufficient amine groups to stabilize an emulsion of the polymer with a hydrophilic solvent when protonated.

As used herein, "drying" relates to exposing a solution or emulsion to temperatures and times sufficient, e.g., as in a drying oven, to remove hydrophilic solvent to provide a coalesced solid. Thus, a "dryable mixture" relates to a mixture that can be dried to an extent sufficient to provide a coalesced solid mixture.

As used herein, "number average molecular weight" ("Mn") is determinable by gel permeation chromatography relative to polystyrene standards. To measure such, emulsions can be dissolved in tetrahydrofuran ("THF"), then filtered through a 0.5-micron disposable filter and run in the aforementioned solvent at a flow rate of 1.2 mL/min using a Jordi Gel DVB mixed bed column, 50 cm×10 mm (ID), on a Water Model 410. The column oven temperature was maintained at 35° C. The injection size was 150 microliters of a 0.15% (w/v) solution. The samples were monitored at a sensitivity of 8× and a scale factor of 20. Data acquisition and handling were with Sigma Ultratek software.

As used herein, the term "unsaturation number enhancer element" relates to an additive or reactant whose addition or presence increases the extent of ethenic unsaturation in a dried polymeric film, as compared to a dried polymeric film differing only by the absence of said additive or reactant.

Disclosed herein are coated films suitable for UV-inkjet printing applications using UV-curable inkjet ink. The coated films may be particularly suitable for use as printable labels due to their excellent wet-scratch resistance, ink gloss, and ink adhesion. The films can be clear, translucent, or opaque structures, having one or more layers.

The coated film comprises a film substrate and a coating composition. In one embodiment, the film substrate is a biaxially oriented cavitated polypropylene/polybutylene terephthalate film. In another embodiment, the film substrate is a biaxially oriented coextruded polyolefin film having a skin layer comprising a random copolymer of ethylene and propylene. The coating composition may comprise a cationic, amino-functional polymer. The coated film may be used to form an imaged article by inkjet printing onto the coated surface of the film substrate with a UV-curable inkjet ink.

In some embodiments one of the outermost surfaces of the film substrate may be metallized. Application of a metal coating layer may be accomplished by vacuum deposition, or any other metallization technique, such as electroplating or sputtering. The metal may be aluminum, or any other metal capable of being vacuum deposited, electroplated, or sputtered, such as, for example, gold, zinc, copper, or silver, chromium, or mixtures thereof.

One or both of the outer exposed surfaces of the film substrate may be surface-treated to increase the surface energy of the film. The surface treatment may aid in rendering the film more receptive to metallization, coatings, printing inks, and/or lamination. The surface treatment can be carried out according to any method known in the art. Preferred methods include, but are not limited to, corona discharge, flame treatment, plasma treatment, chemical treatment, or treatment by means of a polarized flame. In some embodiments, the film may first be treated, for example by flame treatment, and then be treated again in the metallization chamber, for example by plasma treatment, immediately prior to being metallized.

Film Substrate

The film substrate to be coated may be a single layer film or a multilayer film. In some embodiments, the film substrate is a multilayer film that comprises a core layer, one or more optional tie layers, and one or more skin layers. For example, in some embodiments, the film substrate may comprise a core layer, one or more skin layers on either side of the core layer, and/or one or more tie layers disposed between the core layer and the one or more skin layers.

The film substrate may include any film-forming polyolefin. For example, the film substrate may comprise one or more polymers selected from polyethylene, polypropylene, isotactic polypropylene ("iPP"), high crystallinity polypropylene ("HCPP"), ethylene-propylene copolymers, ethylene-propylene random copolymer, ethylene-propylene block copolymers, propylene-butene copolymers, ethylene-propylene-butylene terpolymers, high density polyethylene ("HDPE"), medium density polyethylene ("MDPE"), low density polyethylene ("LDPE"), linear low density polyethylene ("LLDPE"), syndiotactic polypropylene (sPP), and combinations thereof. The polymers may be produced by Ziegler-Natta catalyst, metallocene catalyst, or any other suitable means.

In one embodiment, the film substrate comprises a syndiotactic polypropylene ("sPP") having an isotacticity of less than 25%, or less than 15%, or less than 6%. The mean length of the syndiotactic sequences may be greater than 20, or greater than 25.

In another embodiment, the film-forming polyolefin may be an iPP which has an isotacticity in the range of about 93% to about 99%, a crystallinity in the range of about 70% to about 80%, and a melting point in the range of about 145° C. to about 167° C.

Polypropylene copolymers, if used in the film substrate, may include one or more comonomers. Preferably the comonomer is selected from one or more of ethylene or butene. The propylene is generally present in such co- or terpolymers at greater than 90 wt %.

The film substrate may include one or more additives. Examples of useful additives include, but are not limited to, opacifying agents, pigments, colorants, cavitating agents, slip agents, antioxidants, anti-fog agents, anti-static agents, anti-block agents, moisture barrier additives, gas barrier additives, hydrocarbon resins, hydrocarbon waxes, fillers such as calcium carbonate, diatomaceous earth, and carbon black, and combinations thereof. Such additives may be used in effective amounts, which vary depending upon the property required. If the film substrate is a multilayer film, the additive(s) may be included in any one or more of the layers.

The total thickness of the film substrate can range from 7.5 to 750 microns. Clear label films are generally 25 to 75 microns, with one embodiment being 35 to 55 microns. Cavitated (or opaque) and translucent film substrates for labels can have a thickness from 50 to 250 microns, with one embodiment being 60 to 100 microns. Films used for flexible packaging (clear or opaque) tend to be thinner than labels, and may be in the range of 7.5 to 50 microns, or in some embodiments 12 to 40 microns.

The film substrate may be monoaxially or biaxially oriented. Orientation in the direction of extrusion is known as machine direction ("MD") orientation. Orientation perpendicular to the direction of extrusion is known as transverse direction ("TD") orientation. Orientation may be accomplished by stretching or pulling a film first in the MD followed by the TD. Orientation may be sequential or simultaneous, depending upon the desired film features. Preferred orientation ratios are commonly from between about three to about six times in the MD and between about four to about ten times in the TD.

Blown films may be oriented by controlling parameters such as take up and blow up ratio. Cast films may be oriented in the MD direction by take up speed, and in the TD through use of tenter equipment. Blown films or cast films may also be oriented by tenter-frame orientation subsequent to the film extrusion process, in one or both directions. Typical commercial orientation processes are BOPP tenter process and LISIM technology.

Coating Composition

The film substrate is coated on one or both sides with a coating composition which may be applied by any means known in the art as a continuous film or as a pattern. In coated areas, the application rate of the coating can be between 0.05 and 5 g/msi. Economics generally favor thinner coating layers, however, one might choose to use thicker layers of coatings to impart stiffness, moisture or gas barrier, seal strength, or optical effects (e.g., color, opacity, or a matte finish) to the plastic film.

Before applying the coating composition to the film substrate, the outer surface of the film may be treated to increase its surface energy. This treatment may help to ensure that the coating layer will be strongly adhered to the outer surface of the film, and thus reduce the possibility of the coating peeling or being stripped from the film. This treatment can be accomplished by employing known techniques, such as flame treatment, plasma, corona discharge, film chlorination, treatment with oxidizing agents such as chromic acid, hot air or steam treatment, and the like. A preferred method is corona discharge where the film surface is exposed to a high voltage corona discharge while passing the film between a pair of spaced electrodes. After surface treatment, the coating composition may then be applied thereto. In embodiments where the coating is applied to the surface of the film substrate that has been metallized, the metal layer may be surface treated prior to applying coating, although such treatment is typically not necessary due to the relatively high surface energy of freshly metallized surface.

The coatings are preferably applied by an emulsion coating technique, but may also be applied by co-extrusion, and/or lamination. The coating composition may be applied to the film as a solution. For example, an aqueous or organic, e.g. ethanol, ketone, ester, etc., solvent solution may be used. However, since the coating can contain insoluble, finely divided inorganic materials which are difficult to keep well dispersed in organic solvents, it is preferable that the coating be applied in other conventional manners, such as by rod, direct gravure coating (forward and reverse), offset gravure, slot die, air knife, roll coating, dipping, spraying, and the like. Alternatively, the coating can be 100% solids based, i.e. a solvent-less coating, which means that there is no solvent to dry off. Typically, a solvent-less coating may be cured via, for example, an electron beam-process.

The coating composition may be applied in such an amount so that there will be deposited upon drying a smooth, evenly distributed layer. The coating may be dried by hot air convection, electron beam, radiant heat (e.g., ultraviolet or microwave), or by any other conventional means. Generally, the coating composition is on the order of 0.1 μm to 5 μm in thickness or in the range of 0.31 g to 5.43 g of coating per square meter of film.

In some embodiments, film substrate is coated with the coating composition so that the finished plastic film has a dry coating weight of at least 0.05 g/msi. In applications requiring a clear finish, the dry coating weight may be in the range of about 0.075 to 0.15 g/msi. In applications using filled coatings to create a matte or opaque finish, the dry coating weight may be in the range of 0.05 g/msi to 5 g/msi, or in the range of 0.5 g/msi to 3 g/msi.

In one aspect, the coating composition comprises a cationically stabilizable amino-functional polymer having a number-average molecular weight ("Mn") of greater than 3000, or greater than 5000, which exists in the presence of water as a solution or stable emulsion only when the pH is less than or equal to 8, and which upon drying contains ethenically unsaturated moieties selected from the group consisting of acrylic, methacrylic, and enamine.

In some embodiments, the amino-functional polymer comprises an amino-functional styrenated acrylic polymer with an Mn in the range of 5,000 to 80,000 daltons, or in the range of 8,000 to 20,000 daltons and a weight-average molecular weight in the range of 10,000 to 200,000 daltons, or in the range of 15,000 to 50,000 daltons.

The amino-functional polymer may be a condensation product of a reaction between an amino-functional polymer comprising reactive amine hydrogens with an element selected from the group consisting of halo-functional monomer, halo-functional oligomer, carbonyl-functional monomer, carbonyl-functional oligomer, epoxy-functional monomer, epoxy-functional oligomer, poly-functional acrylic monomer, poly-functional acrylic oligomer, poly-functional methacrylic monomer, and poly-functional methacrylic oligomer, said element containing or forming upon drying an ethenically unsaturated moiety selected from the group consisting of acrylic, methacrylic, and enamine. In one embodiment, said element is present in an amount sufficient to consume greater than 50%, or greater than or equal to 90%, of reactive amine hydrogens of said amino-functional polymer.

In an embodiment, said element is selected from the group consisting of 2-hydroxy-3-chloropropylacrylate, glycidyl methacrylate ("GMA"), glycidyl acrylate, and acetoacetoxyethyl methacrylate ("AAEM"), acetoacetoxyethyl acrylate, acetoacetoxy(methyl)ethyl acrylate, acetoacetoxypropyl acrylate, acetoacetamidoethyl acrylate, acetoacetamidoethyl methacrylate, and acetoacetoxybutyl acrylate.

In one embodiment, the amino-functional polymer may be a cationically stabilizable emulsion polymer that comprises on a dry basis:

i) 3 to 70 wt %, preferably 5 to 45 wt %, or more preferably 7 to 20 wt %, of at least one water-soluble polymeric compound having a Mn greater than 5000, or greater than 7500, or preferably greater than 9000, or greater than 10,000, which comprises a moiety selected from the group consisting of primary amines, secondary amines, tertiary amines, and quaternary ammonium salts; and ii) 30 to 97 wt %, preferably 55 to 95 wt %, or more preferably 80 to 93 wt %, of at least one vinylic, non-acidic monomer which is uncharged or positively charged in an aqueous solution having a pH between 1 and 8.

The cationically stabilizable emulsion polymer may have a calculated glass transition temperature that is less than 35° C.

The vinylic, non-acidic monomer may be selected from the group consisting of acrylic acid ester of $C_1$ to $C_8$ alcohol, methacrylic acid ester of $C_1$ to $C_8$ alcohol, acrylonitrile, methacrylonitrile, acrylamide, methacrylamide, N-substituted acrylamide, N-substituted methacrylamide, N-vinyl lactam, vinyl pyrrole, epoxy-functional vinyl compound, halogenated vinyl compound, vinyl monomer having a vinyl ester of an up to $C_6$ saturated aliphatic monocarboxylic acid, vinyl ether, alkyl vinyl ketone, diester of α-, β-unsaturated dicarboxylic acid, butadiene and styrene. The $C_1$ to $C_8$ alcohol can be unsubstituted or it may comprise an additional moiety selected from the group consisting of halogen, hydroxyl, amino, aziridino, alkyoxy, and epoxy. The epoxy-functional vinyl compound can be selected from the group consisting of 3,4-epoxy-1-butene, and 2-X-3,4-epoxy-1-butene, where X is selected from the group consisting of fluoride, chloride, and bromide. In a preferred embodiment, the vinylic, non-acidic monomer is an epoxy-functional monomer selected from the group consisting of glycidyl acrylate and glycidyl methacrylate.

In one embodiment, the cationically stabilizable emulsion polymer comprises a blend of vinylic, non-acidic monomers which include a) a nitrogen-containing monomer, b) a monomer that is either epoxy-functional or carbonyl-functional, and c) an acrylic or methacrylic ester. In a preferred embodiment, a) is selected from the group consisting of acrylonitrile and methacrylonitrile, b) is selected from the group consisting of glycidyl methacrylate, glycidyl acrylate, acetoacetoxyethyl methacrylate, acetoacetoxyethyl acrylate, acetoacetoxy (methyl)ethyl acrylate, acetoacetoxypropyl acrylate, acetoacetamidoethyl acrylate, acetoacetamidoethyl methacrylate, and acetoacetoxybutyl acrylate, and c) is selected from the group consisting of acrylate ester and methacrylate ester, said esters being made from alcohols of 1 to 8 carbon atoms. In another embodiment, the blend of vinylic, non-acidic monomers comprises 5 to 25% a), 5 to 20% b), and 55 to 90% c), such that the calculated glass transition temperature of said additional polymer upon drying is <25° C. before cross-linking.

The water-soluble polymeric compound may comprise nitrogen-containing monomer selected from the group consisting of acrylonitrile and methacrylonitrile. In some embodiments, the water-soluble polymeric compound is an acidified aminoethylated interpolymer such as the one described in U.S. Pat. No. 3,719,629, incorporated herein by reference. The acidified aminoethylated interpolymer may have pendant amino alkylate groups of the general formula: $CO_2(CHR_1CHR_2NH)_nH$, where $R_1$ and $R_2$ are selected from the group consisting of hydrogen and lower alkyl radicals comprising one to six carbon atoms, where the average value of n ranges from about 1.0 to 2.5.

In another embodiment, the cationically stabilized emulsion polymer comprises a combination of at least one polymerizable monomer, which is uncharged or positively charged in an aqueous solution having a pH between 1 and 8, polymerized in the presence of at least one water-soluble polymer having a Mn greater than 5000, which comprises a moiety selected from the group consisting of primary amines, secondary amines, tertiary amines, and quaternary ammonium salts, with less than 5 wt % of the monomer units in the water-soluble polymer being comprised of copolymeric units derived from at least one member selected from the group consisting of carbohydrates, modified carbohydrates, polyamide-polyamine epichlorohydrin, and units having the following formula:

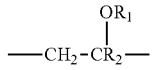

wherein $R_1$ is selected from the group consisting of H, $C_1$ to $C_6$ alkyl, $C_1$ to $C_6$ acyl, and $R_2$ is selected from the group consisting of H, $C_1$ to $C_6$ alkyl, and the reaction product of epichlorohydrin with polyamides containing the following recurring groups:

$$—NH(C_nH_{2n}HN)_x—COR_3CO—$$

where n and x are each 2 or more and $R_3$ is a divalent organic radical of a dicarboxylic acid. In one embodiment, the coating composition comprises on a dry basis (a) 30-97 wt % of at least one vinylic, non-acidic monomer which is uncharged or positively charged in an aqueous solution having a pH between 1 and 8 as described above and (b) 3 to 70 wt % of at least one water-soluble polymeric compound as described above.

In yet another embodiment, the coating composition comprises a curable mixture comprising i) polymeric amine having a number-average molecular weight of >3000 and covalently bonded side chains of at least one of a) ethenically unsaturated moieties selected from the group consisting of acrylic, methacrylic, and enamine, and b) precursors of ethenically unsaturated moieties selected from the group consisting of 2-hydroxy-3-chloropropylacrylate, glycidyl methacrylate (GMA), glycidyl acrylate, acetoacetoxyethyl methacrylate (AAEM), acetoacetoxyethyl acrylate, acetoacetoxy (methyl)ethyl acrylate, acetoacetoxypropyl acrylate, acetoacetamidoethyl acrylate, acetoacetamidoethyl methacrylate, and acetoacetoxybutyl acrylate; ii) epoxy cross-linking catalyst; and iii) cross-linking agent.

An emulsion may be formed with the amino-functional polymer and a hydrophilic solvent. The emulsion may be applied to the film substrate to produce a coated film substrate. The amino-functional polymer is soluble in hydrophilic solvents and will form a hydrophilic solvent-based emulsion at pH values less than or equal 8 and is unstable in hydrophilic solvent-based systems at pH values greater than 8. For present purposes, hydrophilic solvents are those which are soluble in water, including, e.g., water, water-soluble alcohols, glycols and glycol ethers, nonionic emulsifiers, or cationic emulsifiers having an Mn that is less than 5000. In one embodiment, removal of water from the amino-functional polymer shifts equilibria to favor the formation of ethenic unsaturation via condensation when said emulsion is dried in the presence of an unsaturation number enhancer element selected from the group consisting of:

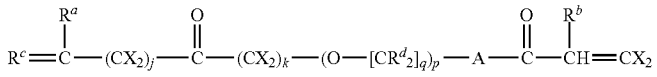

and

-continued $$Y-(CX_2)_m-(O-[CR^d{}_2]_q)_p-A-\overset{\overset{\displaystyle O}{\|}}{C}-\overset{\overset{\displaystyle R^b}{|}}{CH}=CX_2,$$

where Y is selected from the group consisting of halogen and three-membered oxirane ring, $R^a$ and $R^b$ are the same or different and selected from the group consisting of H and $C_1$ to $C_6$ alkyl, $R^c$ is selected from the group consisting of O and $CX_2$, each X can be the same or different and is selected from the group consisting of H, hydroxyl, and halogen, $R^d$ is selected from the group consisting of H, hydroxyl, halogen, and any organic radical containing at least one carbon atom, wherein each $R^d$ can be the same or different, A is selected from the group consisting of O and $NR^d$, $CR^d$ and $CR^d{}_2$ can each be a separate moiety or a portion of a cyclic structure, j, k, and m are integers ranging from 0 to 6, inclusive, q is an integer ranging from 1 to 6, inclusive, and p is an integer ranging from 0 to 30, inclusive. In one embodiment, such an emulsion comprises (a) 70-90 wt % of the amino-functional polymer as described above and (b) 1-30 wt % of the unsaturation number enhancer element as described above.

In some embodiments, the amino-functional polymer can have at least some ethenic unsaturation covalently bonded to the polymer before drying. In such an embodiment, the amino-functional polymer can be mixed with at least one additional polymer selected from the group consisting of nonionic polymer and cationic polymer. In one embodiment, the coating composition comprises a) 1 to 50 wt. % of the amino-functional polymer in which at least some ethenic unsaturation is covalently bonded to the polymer before drying as described above, and b) 50 to 99 wt. % of at least one additional polymer selected from the group consisting of nonionic polymer and cationic polymer.

The coating composition may further comprise at least one additive that provides an improved coating. Such an additive can be selected from the group consisting of: cross-linking compound, curing catalyst such as an epoxy curing catalyst, coating process-facilitating adjuvant, cationic wax dispersion, nonionic wax dispersion, nonionic slip additive, cationic slip additive, cationic colloidal silica, mineral filler, plastic pigment, anti-static additive, UV absorber, UV stabilizer, biocide, adhesion promoter, and security taggant. In one embodiment, the cross-linking compound comprises at least one element selected from the group consisting of $$R^c=\overset{\overset{\displaystyle R^a}{|}}{C}-(CX_2)_j-\overset{\overset{\displaystyle O}{\|}}{C}-(CX_2)_k-(A-[CR^d{}_2]_q)_p-A-(CX_2)_m-\overset{\overset{\displaystyle O}{\|}}{C}-(CX_2)_n-\overset{\overset{\displaystyle R^b}{|}}{CH}=R^c \quad \text{and}$$

$$Y-(CX_2)_m-(O-[CR^d{}_2]_q)_p-O-(CX_2)_n-Y,$$

where Y is selected from the group consisting of halogen and three-membered oxirane ring, $R^a$ and $R^b$ are the same or different and selected from the group consisting of H and $C_1$ to $C_6$ alkyl, $R^c$ is selected from the group consisting of O and $CX_2$, each X can be the same or different and is selected from the group consisting of H, hydroxyl, and halogen, $R^d$ is selected from the group consisting of H, hydroxyl, halogen, and any organic radical containing at least one carbon atom, wherein each $R^d$ can be the same or different within the same molecule, A is selected from the group consisting of O and $NR^d$, $CR^d$ and $CR^d{}_2$ can each be a separate moiety or a portion of a cyclic structure, j, k, m and n are integers ranging from 0 to 6, q is an integer ranging from 1 to 6, inclusive, and p is an integer ranging from 0 to 30, inclusive. In another embodiment of the invention, in the cross-linker, Y is a three-membered oxirane ring, A is oxygen, X and $R^d$ are hydrogen, $R^a$ and $R^b$ are the same or different and are selected from hydrogen or methyl, $R^c$ is oxygen, n is equal to 1, q is equal to 2, m equals 1 or 2, and p is ≤10. In another embodiment of the dryable mixture, in the unsaturation number enhancer element (which is an adhesion-promoting element in this embodiment), Y is a three-membered oxirane ring, A is oxygen, $R^a$ and $R^b$ are the same or different and selected from hydrogen and methyl, $R^c$ is oxygen, X and $R^d$ are hydrogen, n is equal to 1, q is equal to 2, m equals 1 or 2, and p is ≤10.

Coating process-facilitating adjuvants may include defoamers, wetting agents, lubricants, and the like. For example, the coating composition when applied to the substrate layer may not "wet out" uniformly, especially when such materials are applied in very thin layers. As a result, the dry but as yet uncured liquid mixture may retract into droplets or "islands." Also, high-speed applications of coatings can generate foam. Volatile additives are generally preferred over non-volatile defoamers and surfactant-like wetting aids. For example, an ethylene glycol monohexyl ether, such as Hexyl Cellosolve™ commercially available from Union Carbide, may facilitate wetting of the coating on the film substrate and help to control foam. Typically the wet coating formulation can comprise from 0.2 wt % up to about 10 wt % of such volatile processing additives.

Useful adhesion promoters can be incorporated into the coating composition to improve anchorage of the coating to certain substrates or to improve adhesion of a topcoat or ink to a substrate that has been coated with the formulated cationic polymer emulsion. Examples of adhesion promoters include, but are not limited to, chelated alkoxy titanates or derivatives of phosphinic acid, phosphonic acid, or phosphoric acid.

Adhesion of UV-curable inks to a substrate coated with the cationic polymer emulsions may be improved by including polyfunctional acrylates resulting from the esterfication of a polyol with (meth)acrylic acid or a polyallyl derivative as described in Republic of South Africa Patent Application 970523, incorporated herein by reference. Alternatively, one can accomplish the same purpose with epoxy acrylates formed with the reaction of a glycidyl ether of a member selected from the group consisting of polyethylene glycol and polypropylene glycol; and an unsaturated acid selected from the group consisting of acrylic acid and methacrylic acid. The presence of these non-volatile acrylate components can improve ink adhesion inasmuch as they add reactive double bonds to the coating composition, which can react with double bonds in UV-curable inks or lithographic inks. To hinder premature self-reaction during storage, one can incorporate a stabilizer, e.g., one selected from the group consisting of methyl ether of hydroquinone and hydroquinone.

UV-Curable Inkjet Ink

Any UV-curable inkjet ink may be used to form the ink print image on the coated film. The UV-curable inkjet ink may generally comprise monomers and/or oligomers, photoinitators, and various pigments or additives. The ink may also optionally contain various alcohols, photosensitizers, and performance additives such as pigment dispersants and defoamers.

The monomers are typically a blend of monomers which provide a low viscosity, help enhance cure speed, and improve the ink adhesion. In some embodiments, the monomers are low-viscosity acrylates that function as reactive diluents, cross-linkers, and performance property enhancers. They generally have a viscosity in the range of 5 to 25,000 cps. The monomers may be mono-, di-, or tri-functional.

The oligomers are typically present in small quantities to aid in pigment dispersion. The oligomers are typically higher-molecular weight than the monomers and may have molecular weights in the range of 1,000-30,000. In some embodiments, the oligomers may include acrylated urethanes, epoxies, polyesters, and acrylics.

In one embodiment, photopolymerizable monomers and/or oligomers may be used. The photopolymerizable monomers and oligomers may be selected from epoxy monomers and oligomers, vinyl ether monomers and oligomers, and combinations thereof known to undergo cationic polymerization. Epoxy monomers and oligomers and vinyl ether monomers and oligomers with two or more reactive groups may be used to increase crosslinking. Mixtures of epoxy and vinyl either monomers and oligomers may also be used.

The epoxy monomers or oligomers may have at least one oxirane moiety of the formulae:

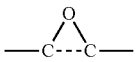

and a viscosity below 500 cps (at 25° C. and in the absence of solvent) and undergo cationic polymerization may be used. Non-limiting examples of suitable epoxy monomers and oligomers include "1,2-cyclic ethers" and aliphatic, cycloaliphatic, aromatic or heterocyclic epoxies and having an epoxy equivalency in the range of 1 to 6, or in the range of 1 to 3. Non-limiting examples include propylene oxide, styrenic oxide, vinylcyclohexene oxide, vinylcyclohexene dioxide, glycidol, butadiene oxide, diglycidyl ether of bisphenol A, oxetane, octylene oxide, phenyl glycidyl ether, 1,2-butane oxide, cyclohexeneoxide, 3,4-epoxycylohexylmethyl-3,4-epoxycyclohexanecarboxylate, 3,4-epoxy-6-methylcyclohexanecarboxylate, bis(3,4-epoxy-6-methylcyclohexylmethyl)adipate, dicyclopentadiene dioxide, epoxidized polybutadiene, 1,4-butanediol diglycidyl ether, polyglycidyl ether of phenolformaldehyde resin or novolak resin, resorcinol diglycidyl ether, epoxy silicones, e.g., dimethylsiloxanes having cycloaliphatic epoxide or glycidyl ether groups, aliphatic epoxy modified with propylene glycol and dipentene dioxide.

Conventional vinyl ether monomers and oligomers which a) have at least one vinyl ether group —O—CR'═CRH, wherein R and R' are each, independently, H or C1-8 alkyl, b) have a viscosity below 500 cps (at 25° C. and in the absence of solvent) and c) undergo cationic polymerization may also be used. Examples of suitable monomers and oligomers having at least one or more vinyl ether groups include those of the following general formula:

$$(RCH{=}CR'{-}O{-}Z')n{-}B$$

where R and R' are each, independently H or C1-8 alkyl, Z' is a direct bond or a divalent moiety having C1-20 carbon atoms selected from the group consisting of alkylene, cycloalkylene, or polyalkylene ether moieties, n is an integer from 1 to 4, B is hydrogen or a moiety derived from aromatic and aliphatic hydrocarbons, esters, ethers, siloxanes, urethanes, and carbonates, of from 1 to 40 carbon atoms. Suitable vinyl ether monomers include ethyl vinyl ether, propyl vinyl ether, isobutyle vinyl ether, octadecyl vinyl ether, hydroxybutyl vinyl ether, propenyl ether of propylene carbonate, dodecyl vinyl ether, cyclohexyl vinyl ether, 2-ethylhexyl vinyl ether, butyl vinyl ether, ethyleneglycol monovinyl ether, diethyleneglycol divinyl ether, butanediol monovinyl ether, butane diol divinyl ether, hexane diol divinyl ether, ethylene glycol butyl vinyl ether, triethylene glycol methyl vinyl ether, cyclohexane dimethanol monovinyl ether, cyclohexane dimethanol divinyl ether, 2-ethylhexyl vinyl ether, and poly-THF divinyl ether.

In some embodiments, an alcohol is used to modify the properties of the ink and the image obtained. Monofunctional alcohols function to terminate chain length while multifunctional (trifunctional) alcohols can provide crosslinking and can speed up the kinetics of the reaction. Generally low molecular weight (low viscosity) alcohols and/or low boiling alcohols are preferred. Examples of suitable alcohols include ethylene glycol, polyether polyols, diethylene glycol, triethylene glycol, 1,2-propylene glycol, dipropylene glycol, 1,3-butanediol, 1,4-butanediol, neopentyl glycol, trimethylol propane, 1,6-hexanediol, pentaerythritol, trimethylol propane, tetramethylolpropane, dipentaerythritol, dihydroalcohols with a molecular weight of 3000 or less such as tone polyols, and the like.

The photoinitiator is generally chosen based on the desired cure speed of the ink and the pigments/dyes used. Preferred photoinitiators are free radical-generating photoinitators, which produce free radicals by bond scission upon exposure to UV-light. For example, quinine compounds may be used to generate free radicals such. Other examples of photoinitiators include benzophenone, benzyl dimethyl ketal, and 2-hydroxy-2-methyl-1-phenyl-1-propane. In one embodiment, suitable photoinitiators include those compounds which form aprotic acids or Bronstead acids upon exposure to UV light sufficient to initiate polymerization. In another embodiment, a cationic photoinitiator such as Aryldiazonium salts, diaryliodonium salts, triarylsulphonium salts, triarylselenonium salts, dialkylphenacysulphonium salts, aryloxydiarylsulphoxonium salts, and dialylphenacylsulphonium salts may be used. Most cationic UV photoinitiators absorb photon energy at a wavelength in the range of 360-450 nm.

The photoinitiator used may be a single compound, a mixture of two or more active compounds or a combination of two or more different compounds, i.e., co-initiators which form part of a multicomponent imaging system. For example, a combination of diaryl iodonium cation and tetrakis(pentafluorophenyl)borate anion may be used. The photoinitiator is preferably incorporated in the ink in an amount in the range of 0.01 to 10 wt %, or in the range of 1 to 5 wt %, based on the total weight of the ink formulation. When the amount of photoinitator is too small, cure is insufficient and where an excessive amount is used, rapid cure results in a decrease molecular weight and reduced smear resistance.

A photosensitizer may be used with the photoinitator in an amount in the range of 0.01 to 10 wt %, based on the total weight of the ink formulation. Photosensitizers are often added to shift the light absorption characteristics of a system. The photosensitizer should be chosen to be compatible with the photoinitiator used; for example, the photosensitizer anthracene may be used with a diphenyliodonium cation photoinitiator. Other examples of photosensitizers include anthracene, pery-lene, phenothiazine, xanthone, thioxanthone, and benzophenone.

In some embodiments, a photopolymerization initiation assistant may also be used. This is an agent which is not activated itself by ultraviolet radiation itself but which, when used with a photoinitiator, helps speedup the initiation of polymerization, thus realizing a more efficient cure.

Suitable light sources for curing the ink compositions of the present invention depend on the photoinitiator used. Those photoinitiators responsive to the UV light can be activated by high pressure mercury lamps, xenon-lamps, arc lamps and gallium lamps.

The ink formulations may contain a coloring agent such as an organic or inorganic dye or pigment. Examples of coloring agents include phthalocyanine dyes, carbon blacks, fluorescent naphthalimide dyes and others such as cadmium, primrose, chrome yellow, ultra marine blue, iron oxide, zinc oxide, titanium oxide, cobalt oxide, nickel oxide, etc. Reactive dyes such as leuco dyes and diazonium compounds may also be used. The total amount of coloring agent is typically in the range of 0.01 to 10 wt % of the total ink formulation.

Dispersing agents may optionally be used in the ink formulation to help solubilize the pigment or dye.

Conventional fillers, defoaming agents, flow adjusters, leveling agents or cobwebbing preventative agents may also be incorporated to improve the properties as jet printing inks. Illustrative examples of flow adjusters include low molecular weight organopolysiloxanes such as methylpolysiloxanes which may be used in an amount in the range of 0.01 to 10 wt % based on weight of the total ink formulation. A defoamer, i.e., a surfactant, may be used in an amount in the range of 0.01 to 10 wt % based on the weight of the total ink formulation. Illustrative examples of leveling agents include low molecular weight polysiloxane/polyether copolymers and modified organic polysiloxanes, which may be used in an amount in the range of 0.01 to 10 wt. % based on the weight of the total ink formulation.

Other suitable additives that may be used include those which reduce bacterial growth, modify viscosity, provide wettability (e.g., butylcarbitol), humectants which prevent the composition from drying out within the print head (e.g., polyethylene glycols), enhance the conductivity of the ink formulation for use in continuous ink jet printers, and photostabilizers which prevent polymerization of inks by natural or ambient light where the photoinitiator is activated by UV radiation.

Plasticizers may also be used to aid flexibility of the image formed and/or reduce the viscosity of the ink. Suitable plasticizers include adipic acid esters, phthalic acid esters and ricinoleate acid esters, citrates, epoxides, glycerols, glycols, hydrocarbons and chlorinated hydrocarbons, phosphates and the like. Other suitable additives include oil, weatherability improvers such as UV light absorbers, flexibilizers (oil) and fillers.

The above ink components can be mixed and dispersed uniformly by an appropriate means such as a simple impeller within a vessel or a roll mill to obtain the UV-curable inkjet ink.

The ink formulations of UV-curable inkjet ink typically have a viscosity in the range of 1-500 cps at 25° C., or in the range of 1-100 cps, or in the range of 1-25 cps. Where the photopolymerizable monomers have a viscosity much higher than 50 cps, they may be diluted with either a low viscosity co-reactant, such as an alcohols described above, or a low viscosity carrier such as plasticizers or solvents (alcohols or ketones).

In one embodiment the ink composition comprises (a) at least one monomer or oligomer, (b) at least one photoinitiator, and (c) and at least one coloring agent; wherein the UV-curable inkjet ink has a viscosity in the range of 1-500 cps, or in the range of 1-200 cps at 25° C. The coloring agent may be selected from pigments and dyes with a particle size of less than 5 μm. Preferred UV-curable inkjet inks contain no solvent or propellant and contain no particulate matter greater than 5 μm, and have a resistivity of less than 10,000 ohms/cm.

INDUSTRIAL APPLICATION

The film substrate may be prepared by any suitable means. Preferred methods comprise co-extruding, then casting and orienting the film. In one embodiment, the film substrate may be formed by co-extruding the one or more layers through a flat sheet extruder die at a temperature in the range of 200° C. to 260° C., casting the film onto a cooling drum and quenching the film. The sheet is then stretched 3 to 7 times its original size, in the machine direction (MD), followed by stretching 5 to 10 times its original size in the transverse direction (TD). The drawing temperature for the biaxial orientation may be in the range of about 100° C. to about 200° C.

The film substrate may be coated with an embodiment of the above-described coating composition to form a plastic film. The plastic film may comprise A) a film substrate layer; B) a coating comprising embodiments of the coating composition as described above; C) an ink print image on a surface of said coating opposite from said plastic substrate layer. In preferred embodiments a UV-inkjet printer is used to print the image. Such a plastic film can be used in various applications including packaging and labeling.

In one embodiment, the coating is placed on another coating, e.g., poly(ethyleneimine) coating or a layer of metal or metal oxide, such as aluminum or aluminum oxide. In another embodiment, a primer or functional layer can be applied to the coating side of the plastic substrate prior to coating. Examples of the primer for thermoplastic materials include poly(ethyleneimine), which can be coextruded with or coated on the plastic substrate, and the epoxy coating at a low coating weight. Plasma or flame treatment can also be used with or instead of the primer.

In order to provide printable labels, the non-print surface of the coated plastic substrate (i.e., the surface of the substrate opposite the coating) can be coated with various adhesives and have a releasable liner adhered thereon, or with anti-static coatings to improve application performance of coated substrates.

The coated plastic films are especially suitable for UV-inkjet printing. Without being bound by theory, it is believed that the coating composition reacts with the UV-curable inkjet ink. It is believed that when the UV-curable inkjet ink is exposed to the UV-light source during the printing process it generates free-radicals which then cause a chemical reaction with the coating composition. The coating composition comprises a number of reactive double bonds and unsaturation sites which react with the ink to form covalent linkages between the acrylic-functional coating and the UV-curable inkjet ink. The reaction between the coating composition and the UV-curable inkjet ink generates strong bonds which make the printed image more resistant to water and solvents.

In another embodiment, an article is provided where the article comprises (a) a film substrate; (b) a coating composition applied to the film substrate, wherein the coating composition contains a cationically stabilized emulsion polymer that comprises on a dry basis: i) 30 to 97 wt % of at least one vinylic non-acidic monomer which is uncharged or positively charged in an aqueous solution having a pH between 1 and 8; and ii) 3 to 70 wt % of at least one water-soluble polymeric compound having a number-average molecular weight greater than 5000 which comprises a moiety selected from the group consisting of primary amines, secondary amines, tertiary amines, and quaternary ammonium salts; and (c) an ink print image printed on the coating composition by a UV-inkjet printer using UV-curable inkjet ink. In the coating composition at least one of said vinylic non-acidic monomer(s) may be an epoxy-functional monomer selected from the group consisting of glycidyl acrylate and glycidyl methacrylate. In the coating composition the water-soluble polymeric compound may comprise nitrogen-containing monomer selected from the group consisting of acrylonitrile and methacrylonitrile.

In a further embodiment, an article is provided that comprises (a) a film substrate; (b) a coating composition applied to the film substrate, wherein the coating composition contains a cationically stabilized emulsion polymer that comprises on a dry basis:

i. 70 to 99 wt % of an amino-functional polymer; and ii. 1 to 30 wt % of an unsaturation number enhancer element selected from the group consisting of

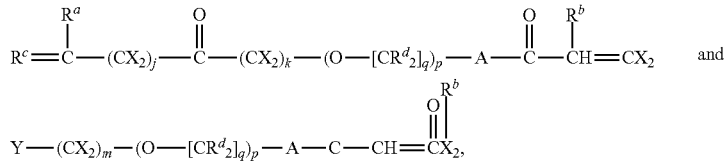

and where Y is selected from the group consisting of halogen and three-membered oxirane ring, $R^a$ and $R^b$ are the same or different and selected from the group consisting of H and $C_1$ to $C_6$ alkyl, $R^c$ is selected from the group consisting of 0 and $CX_2$, each X can be the same or different and is selected from the group consisting of H, hydroxyl, and halogen, $R^d$ is selected from the group consisting of H, hydroxyl, halogen, and any organic radical containing at least one carbon atom, wherein each $R^d$ can be the same or different, A is selected from the group consisting of O and $NR^d$, $CR^d$ and $CR^d{}_2$ can each be a separate moiety or a portion of a cyclic structure, j, k, and m are integers ranging from 0 to 6, inclusive, q is an integer ranging from 1 to 6, inclusive, and p is an integer ranging from 0 to 30, inclusive; and (c) an ink print image printed on the coating composition by a UV-inkjet printer using UV-curable inkjet ink. The amino-functional polymer may be a condensation product of a reaction between an amino-functional polymer comprising reactive amine hydrogens with an element selected from the group consisting of halo-functional monomer, halo-functional oligomer, carbonyl-functional monomer, carbonyl-functional oligomer, epoxy-functional monomer, epoxy-functional oligomer, poly-functional acrylic monomer, poly-functional acrylic oligomer, poly-functional methacrylic monomer, and poly-functional methacrylic oligomer, said element containing or forming upon drying an ethenically unsaturated moiety selected from the group consisting of acrylic, methacrylic, and enamine.

In other embodiments, an image graphics film is prepared by having a UV-inkjet printer jet an image using UV-curable inkjet ink onto the surface of an image receptive medium, wherein the image receptive medium comprises a film substrate and a coating composition as described above.

In another embodiment, an ink jet recording sheet for use with UV-curable inkjet ink is provided wherein the sheet comprises a film substrate and coating composition as described above.

In yet another embodiment, a method of using a film substrate for printing with UV-curable ink in a UV-inkjet printer, comprising jetting an ink image directly on the film substrate with the UV curable ink wherein the film substrate is coated with a coating composition as described above.

In another embodiment, a method of printing with a UV-inkjet printer comprises jetting UV-curable inkjet ink onto the coated film substrate to form an ink printed image. The jetting may be by an inkjet printhead.

In another aspect, a method of printing with an inkjet printer comprising the step of jetting UV-curable inkjet ink onto an image receptive medium comprising a biaxially oriented polypropylene film coated with a coating composition as described above.

All patents and patent applications and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

What is claimed is:

1. An article comprising:

a. a film substrate;

b. a coating composition applied to the film substrate and dried thereupon, wherein the dried coating composition comprises the reaction product of at least one of:

i. a cationically stabilized emulsion polymer that comprises on a dry basis:

1. 30 to 97 wt % of at least one vinylic non-acidic monomer which is uncharged or positively charged in an aqueous solution having a pH between 1 and 8; and 2. 3 to 70 wt % of at least one water-soluble polymeric compound having a number-average molecular weight greater than 5000 which comprises a moiety selected from the group consisting of primary amines, secondary amines, tertiary amines, and quaternary ammonium salts;

ii. a cationically stabilized emulsion polymer that comprises on a dry basis:

1. 70 to 99 wt % of an amino-functional polymer; and
2. 1 to 30 wt % of an unsaturation number enhancer element selected from the group consisting of

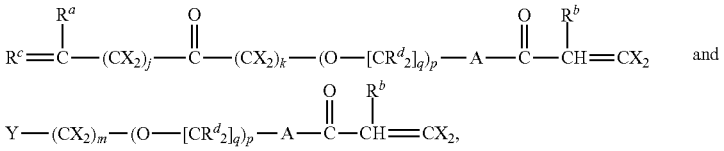

and where Y is selected from the group consisting of halogen and three-membered oxirane ring, $R^a$ and $R^b$ are the same or different and selected from the group consisting of H and $C_1$ to $C_6$, alkyl, $R^c$ is selected from the group consisting of O and $CX_2$, each X can be the same or different and is selected from the group consisting of H, hydroxyl, and halogen, $R^d$ is selected from the group consisting of H, hydroxyl, halogen, and any organic radical containing at one carbon atom, wherein each $R^d$ can be the same or different, A is selected from the group consisting of O and $NR^d$, $CR^d$ and $CR^d_2$ can each be a separate moiety or a portion of a cyclic structure, j, k, m and n are integers ranging from 0 to 6, inclusive, q is an integer ranging from 1 to 6, inclusive, and p is an integer ranging from 0 to 30, inclusive; or iii. a mixture of (i) and (ii);

iv. an ink image layer deposited on the dried coating composition from a UV-inkjet printer, the ink image layer comprising an ink reaction product formed by UV-curing of UV-curable inkjet ink, the UV-curable inkjet ink comprising:

an epoxy monomer, an epoxy oligomer, or combination thereof; and a photoinitiator, a photosensitizer, or combination thereof;

and v. an interlayer reaction product formed between a portion of the ink image layer and a portion of the dried coating composition proximate thereto, the interlayer reaction product being formed upon the UV-curing of the UV-curable inkjet ink.

2. The article of claim 1, wherein the film substrate comprises a polyolefin selected from polypropylene, polyethylene, ethylene-propylene copolymers, propylene-butene copolymers, ethylene-propylene-butylene terpolymers, and blends thereof.

3. The article of claim 1, wherein the film substrate is oriented in at least one direction.

4. The article of claim 1, wherein in the coating composition comprises (i) or (iii) and wherein at least one of said vinylic non-acidic monomer(s) is an epoxy-functional monomer selected from the group consisting of glycidyl acrylate and glycidyl methacrylate.

5. The article of claim 1, wherein in the coating composition comprises (i) or (iii) and wherein said water-soluble polymeric compound comprises nitrogen-containing monomer selected from the group consisting of acrylonitrile and methacrylonitrile.

6. The article of claim 1, wherein the coating composition comprises (ii) or (iii) and wherein the amino-functional polymer is a condensation product of a reaction between an amino-functional polymer comprising reactive amine hydrogens with an element selected from the group consisting of halo-functional monomer, halo-functional oligomer, carbonyl-functional monomer, carbonyl-functional oligomer, epoxy-functional monomer, epoxy-functional oligomer, poly-functional acrylic monomer, poly-functional acrylic oligomer, poly-functional methacrylic monomer, and poly-functional methacrylic oligomer, said element containing or forming upon drying an ethenically unsaturated moiety selected from the group consisting of acrylic, methacrylic, and enamine.

7. A method of printing with a UV-inkjet printer, the method comprising:

jetting UV-curable inkjet ink onto a dried coating composition of a coated film substrate to form an ink image layer there upon, wherein the coated film substrate comprises:

a. a film substrate; and b. a coating composition applied to the film substrate and dried thereupon, wherein the dried coating composition comprises the reaction product of at least one of:

i. a cationically stabilized emulsion polymer that comprises on a dry basis:

1. 30 to 97 wt % of at least one vinylic non-acidic monomer which is uncharged or positively charged in an aqueous solution having a pH between 1 and 8; and
2. 3 to 70 wt % of at least one water-soluble polymeric compound having a number-average molecular weight greater than 5000 which comprises a moiety selected from the group consisting of primary amines, secondary amines, tertiary amines, and quaternary ammonium salts;

ii. a cationically stabilized emulsion polymer that comprises on a dry basis:

1. 70 to 99 wt % of an amino-functional polymer; and
2. 1 to 30 wt % of an unsaturation number enhancer element selected from the group consisting of

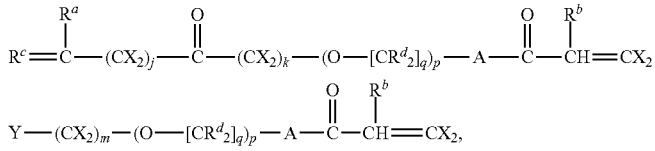

and where Y is selected from the group consisting of halogen and three-membered oxirane ring, $R^a$ and $R^b$ are the same or different and selected from the group consisting of H and $C_1$ to $C_6$ alkyl, $R^c$ is selected from the group consisting of O and $CX_2$, each X can be the same or different and is selected from the group consisting of H, hydroxyl, and halogen, $R^d$ is selected from the group consisting of H, hydroxyl, halogen, and any organic radical containing at least one carbon atom, wherein each Rd can be the same or different, A is selected from the group consisting of O and $NR^d$, $CR^d$ and $CR^d_2$ can each be a separate moiety or a portion of a cyclic structure, j, k, m and n are integers ranging from 0 to 6, inclusive, q is an integer ranging from 1 to 6, inclusive, and p is an integer ranging from 0 to 30, inclusive; or iii. a mixture of (i) and (ii);

iv. UV-curing the ink image layer on the dried coating composition to form in the ink image layer an ink reaction product formed by UV-curing of UV-curable inkjet ink, the UV-curable inkjet ink comprising:

an epoxy monomer, an epoxy oligomer, or combination thereof; and a photoinitiator, a photosensitizer, or combination thereof;

and v. initiating interlayer reaction upon the step of UV-curing, the interlayer reaction being initiated between a portion of the ink image layer and a respective portion of the dried coating composition proximate thereto, the interlayer reaction forming an interlayer reaction product.

8. The method of claim 7, wherein the film substrate comprises a polyolefin selected from polypropylene, polyethylene, ethylene-propylene copolymers, propylene-butene copolymers, ethylene-propylene-butylene terpolymers, and blends thereof.

9. The method of claim 7, wherein the film substrate is oriented in at least one direction.

10. The method of claim 7, wherein in the coating composition comprises (i) or (iii) and wherein at least one of said vinylic non-acidic monomer(s) is an epoxy-functional monomer selected from the group consisting of glycidyl acrylate and glycidyl methacrylate.

11. The method of claim 7, wherein in the coating composition comprises (i) or (iii) and wherein said water-soluble polymeric compound comprises nitrogen-containing monomer selected from the group consisting of acrylonitrile and methacrylonitrile.

12. The method of claim 7, wherein the coating composition comprises (ii) or (iii) and wherein the amino-functional polymer is a condensation product of a reaction between an amino-functional polymer comprising reactive amine hydrogens with an element selected from the group consisting of halo-functional monomer, halo-functional oligomer, carbonyl-functional monomer, carbonyl-functional oligomer, epoxy-functional monomer, epoxy-functional oligomer, poly-functional acrylic monomer, poly-functional acrylic oligomer, poly-functional methacrylic monomer, and poly-functional methacrylic oligomer, said element containing or forming upon drying an ethenically unsaturated moiety selected from the group consisting of acrylic, methacrylic, and enamine.

13. The article of claim 1 and further comprising:

the portion of the dried coating composition comprising acrylic functional groups having reactive double bonds and unsaturation sites, the interlayer reaction product being formed at least in part by reactions between the portion of the ink image layer and the respective portion of the dried coating layer at the acrylic functional groups.

14. The method of claim 7 and further comprising:

in the step of initiating, the portion of the dried coating composition comprising acrylic functional groups having reactive double bonds and unsaturation sites, the interlayer reaction product being formed at least in part by reactions between the portion of the ink image layer and the respective portion of the dried coating layer at the acrylic functional groups.

* * * * *